US010297920B2

(12) United States Patent
Wrigley

(10) Patent No.: US 10,297,920 B2
(45) Date of Patent: May 21, 2019

(54) COMPACT DUAL CIRCULAR POLARIZATION MULTI-BAND WAVEGUIDE FEED NETWORK

(71) Applicant: LOCKHEED MARTIN CORPORATION, Bethesda, MD (US)

(72) Inventor: Jason Stewart Wrigley, Broomfield, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 15/895,983

(22) Filed: Feb. 13, 2018

(65) Prior Publication Data

US 2018/0233829 A1 Aug. 16, 2018

Related U.S. Application Data

(60) Provisional application No. 62/460,042, filed on Feb. 16, 2017.

(51) Int. Cl.

| | |
|---|---|
| ***H01Q 15/24*** | (2006.01) |
| ***H01Q 15/12*** | (2006.01) |
| ***H01Q 13/02*** | (2006.01) |
| ***H01P 1/17*** | (2006.01) |
| ***H01P 1/209*** | (2006.01) |
| ***H01P 5/16*** | (2006.01) |

(52) U.S. Cl.

CPC ..... *H01Q 15/244* (2013.01); *H01P 1/171* (2013.01); *H01P 1/209* (2013.01); *H01P 5/16* (2013.01); *H01Q 13/0241* (2013.01); *H01Q 13/0258* (2013.01); *H01Q 15/12* (2013.01)

(58) Field of Classification Search

CPC .. H01Q 15/244; H01Q 15/12; H01Q 13/0241; H01Q 13/0258; H01P 1/171; H01P 1/209

USPC ..... 343/756

See application file for complete search history.

(56) References Cited

U.S. PATENT DOCUMENTS

| | | | | |
|---|---|---|---|---|
| 4,968,957 A * | 11/1990 | Hudspeth | G01S 7/024 | 333/126 |
| 6,577,207 B2 * | 6/2003 | Volman | H01P 1/16 | 333/125 |
| 8,514,140 B1 * | 8/2013 | Rao | H01Q 13/025 | 343/772 |
| 8,953,647 B1 * | 2/2015 | Mead | H01S 3/06754 | 372/6 |

(Continued)

*Primary Examiner* — Lam T Mai

(74) *Attorney, Agent, or Firm* — Morgan, Lewis & Bockius LLP

(57) ABSTRACT

A transmitter of a feed network includes first and second branches and an integrated branch line coupler that couples the first and second branches. The integrated branch line coupler includes first and second waveguide reject filters in the first and second branches respectively. The first and second waveguide reject filters include one or more single-sided stubs protruding outwardly from outer faces of the first and second waveguide reject filters. The integrated branch line coupler further includes one or more couplers that are coupled between inner faces of the first and second waveguide reject filters. The transmitter includes a core waveguide that is coupled to the first and second branches. The transmitter receives a linearly polarized signal from an input port of the first or second branches and generates a circularly polarized signal in the core waveguide.

20 Claims, 8 Drawing Sheets

(56) References Cited

U.S. PATENT DOCUMENTS

| | | | | |
|---|---|---|---|---|
| 2002/0037698 | A1* | 3/2002 | Stafford | H01P 1/161<br>455/3.02 |
| 2004/0012844 | A1* | 1/2004 | Ohtsuki | B23K 26/0643<br>359/341.1 |
| 2007/0032190 | A1* | 2/2007 | Le Naour | H01P 1/209<br>455/12.1 |
| 2010/0149058 | A1 | 6/2010 | Bosshard et al. | |
| 2012/0169557 | A1* | 7/2012 | Naym | H01Q 25/04<br>343/756 |
| 2017/0219774 | A1* | 8/2017 | Kopp | G02B 5/3016 |

* cited by examiner

COMPACT DUAL CIRCULAR POLARIZATION MULTI-BAND WAVEGUIDE FEED NETWORK

CROSS-REFERENCE TO RELATED APPLICATIONS

This application claims the benefit of priority under 35 U.S.C. § 119 from U.S. Provisional Patent Application 62/460,042 filed Feb. 16, 2017, which is incorporated herein by reference in its entirety.

STATEMENT REGARDING FEDERALLY SPONSORED RESEARCH OR DEVELOPMENT

Not applicable

FIELD OF THE INVENTION

The present invention generally relates to waveguides and more particularly to waveguide feed networks.

BACKGROUND

Waveguide feed networks that can transmit left hand and right hand circularly polarized signals through circular waveguides and also can receive left hand and right hand circularly polarized signals from circular waveguides may require two transmit ports and two receive ports with good isolation between the ports. The waveguide feed networks may require filtering to provide the required isolation between the ports. Transmitter circuits may be coupled to transmit ports and receiver circuits may be coupled to the receive ports for transmitting and receiving the signals.

The waveguide feed network may be coupled to circular waveguides to implement a transformation from a linearly polarized signal at a transmit port to one of the left hand circularly polarized signal or right hand circularly polarized signal at the circular waveguide. Alternatively, the waveguide feed network may implement a transformation from one of the left hand circularly polarized signal or right hand circularly polarized signal at the circular waveguide to a linearly polarized signal at a receive port. This can make the design of an integrated waveguide feed network for transmitting and receiving signals with both left hand circular polarization and right hand circular polarization very complex.

In view of the foregoing, low complexity compact waveguide feed networks are required.

SUMMARY

According to various aspects of the subject technology, a transmitter unit of a feed network for transmitting circularly polarized signals is described. In some embodiments, the transmitter unit includes a first branch having a first input port and a second branch having a second input port. The transmitter unit includes an integrated branch line coupler that couples the first branch and the second branch. The integrated branch line coupler includes a first waveguide reject filter in the first branch. The first waveguide reject filter includes a first end and a second end as well as an outer face and an inner face. The first end of the first waveguide reject filter is coupled to the first input port. The integrated branch line coupler includes a second waveguide reject filter in the second branch. The second waveguide reject filter includes a first end and a second end as well as an outer face and an inner face. The first end of the second waveguide reject filter is coupled to the second input port. The integrated branch line coupler further includes one or more couplers coupled between the inner face of the first waveguide reject filter and the inner face of the second reject filter. The first waveguide reject filter also includes a first group of one or more single-sided stubs protruding outwardly from the outer face of the first waveguide reject filter. The second waveguide reject filter includes a second group of one or more single-sided stubs protruding outwardly from the outer face of the second waveguide reject filter. The transmitter unit further includes a core waveguide that is coupled to the first branch via the second end of the first waveguide reject filer and to the second branch via the second end of the first waveguide reject filer. The transmitter unit receives a linearly polarized signal from one of the first input port or the second input port and generates a circularly polarized signal in the core waveguide.

According to various aspects of the subject technology, a receiver unit of a feed network for receiving circularly polarized signals is described. In some embodiments, the receiver unit includes a first branch having a first output port and a second branch having a second output port. The receiver unit includes an integrated branch line coupler that couples the first branch and the second branch. The integrated branch line coupler includes a first waveguide reject filter in the first branch. The first waveguide reject filter includes a first end and a second end as well as an outer face and an inner face. The first end of the first waveguide reject filter is coupled to a circular waveguide and the second end of the first waveguide reject filter is coupled to the first output port. The integrated branch line coupler includes a second waveguide reject filter in the second branch. The second waveguide reject filter includes a first end and a second end as well as an outer face and an inner face. The first end of the second waveguide reject filter is coupled to the circular waveguide and the second end of the second waveguide reject filter is coupled to the second output port. The integrated branch line coupler includes one or more couplers coupled between the inner face of the first waveguide reject filter and the inner face of the second waveguide reject filter. The integrated branch line coupler receives a circularly polarized signal via the first ends of the first and second waveguide reject filters from the circular waveguide. The integrated branch line coupler generates, based on the received circularly polarized signal, a linearly polarized signal at one of the first output port or the second output port.

According to various aspects of the subject technology, a method of operating a transmitter unit of a feed network for transmitting circularly polarized signals is described. The transmitter unit includes a first branch and a second branch. In some embodiments, the method includes receiving a first linearly polarized signal from an input port of the first branch and transmitting a portion of the first linearly polarized signal via a first waveguide reject filter of the first branch to a circular waveguide. The method includes generating a second linearly polarized signal by providing a quarter wavelength phase shift to a remaining portion of the first linearly polarized signal. The quarter wavelength phase shift is provided via a transmission of the remaining portion of the first linearly polarized signal to the second branch through a branch line coupler. The branch line coupler is coupled between the first waveguide reject filter and a second waveguide reject filter of the second branch. The method further includes transmitting the second linearly polarized signal via the second waveguide reject filter to the circular waveguide. The method also includes combining the portion of the first linearly polarized signal and the second linearly polarized signal. The combination occurs in the circular waveguide generates one of a right hand or a left hand circularly polarized signal in the circular waveguide.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

Figure 1:
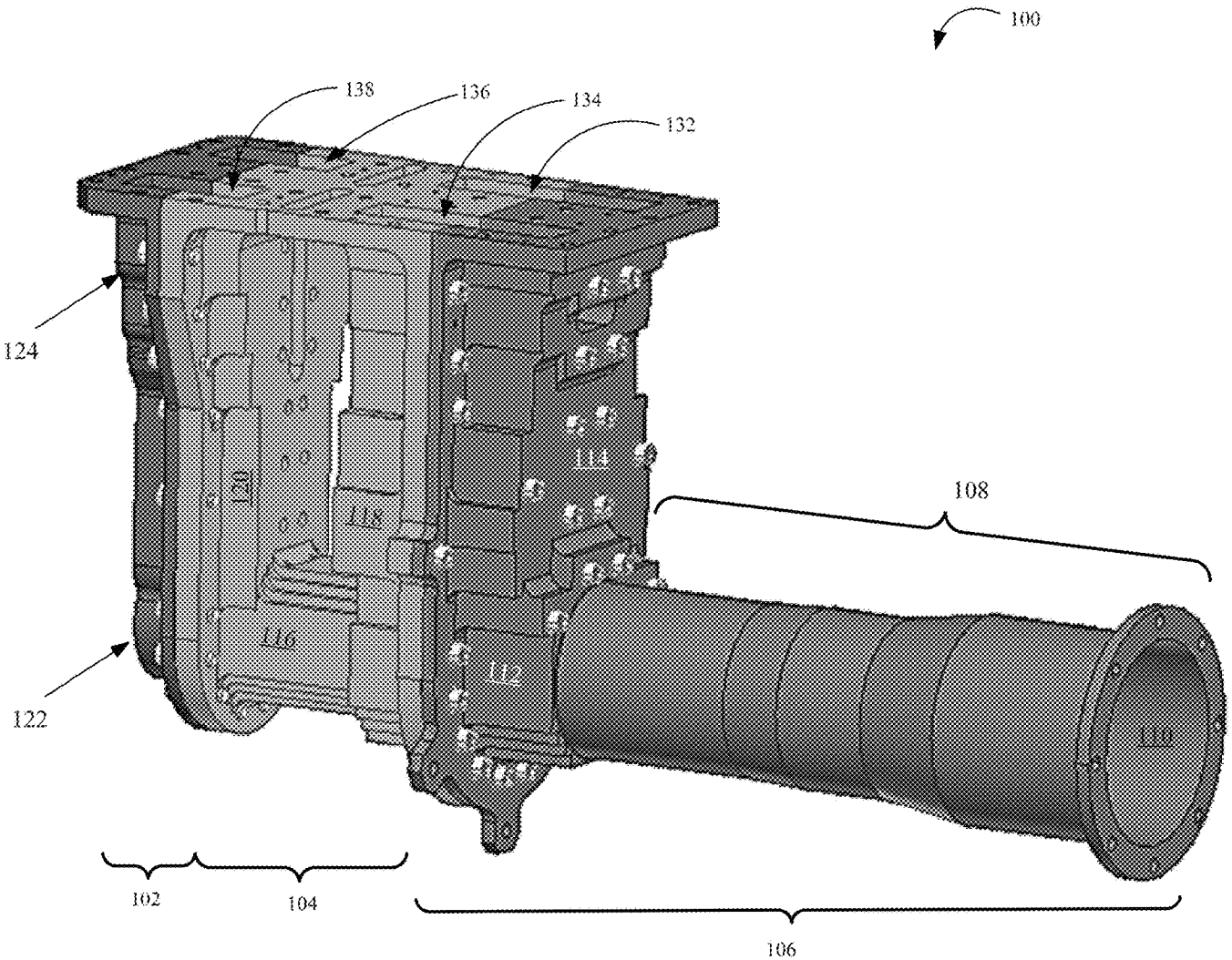
FIG. 1 illustrates a diagram of an example waveguide feed network, according to some aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

The present disclosure is directed, in part, to a feed network with dual circular polarization for satellite communications. A satellite may include a satellite receiver coupled to a satellite antenna system for receiving uplink signals, and may also include a satellite transmitter coupled to the satellite antenna system for transmitting downlink signals. The feed network may be coupled between elements of the satellite antenna system and the satellite receiver and also may be couple between the elements of the satellite antenna system and the satellite transmitter. The feed network that couples the satellite transmitter to the satellite antenna system may transform a linearly polarized signal received from the satellite transmitter into one of a right hand or a left hand circularly polarized signals for the satellite antenna system to be transmitted. Also, the feed network that couples the satellite receiver to the satellite antenna system may transform a received right hand or left hand circularly polarized signal from the satellite antenna system into a linearly polarized signal for the receiver. By providing circularly polarized signals for communication to and from the satellite, the communications may not be sensitive to an orientation of transceiver devices that communicates with the satellite.

The feed network includes a receiver unit and a transmitter unit. The transmitter unit may include two branches and two input ports, a first input port on a first end of a first branch and a second input port on a first end of a second branch. The input ports may also be coupled to circuitry for receiving input signals that can be linearly polarized signals. The transmitter unit can be coupled to a core waveguide, e.g., a circular waveguide, via the second end of the two branches that can include evanescent waveguides and may provide a circularly polarized signal based on the received signals at the input ports. The transmitter unit may provide a left hand circularly polarized signal at the core waveguide when the input signal is received from the first input port and may provide a right hand circularly polarized signal at the core waveguide when the input signal is received from the second input port. The transmitter unit may include an integrated branch line coupler between the two branches for generating the left hand and right hand circularly polarized signals. The integrated branch line coupler may have one or more branches between the first and second branches to form a branch line coupler. The integrated branch line coupler may include waveguide filters performing as waveguide reject filters that are integrated into the first and second branches. The waveguide reject filters may be used for isolating the input ports from undesired signals in the core waveguide. The waveguide reject filters of the integrated branch line coupler may include single-sided stubs that may be used for further tuning the waveguide reject filters.

Additionally, the receiver unit may include two branches and two output ports, a first output port at a first end of a first branch and a second output port at a first end of a second branch. The receiver unit can be coupled to a core waveguide, e.g., a circular waveguide, via the second end of the two branches to receive a left hand or right hand circularly polarized signal. The receiver unit may receive a left hand circularly polarized signal from the core waveguide and may provide a linearly polarized signal at a first output port. Alternatively, the receiver unit may receive a right hand circularly polarized signal from the core waveguide and may provide a linearly polarized signal at a second output port. The receiver unit may include an integrated branch line coupler coupled between the two branches for creating linearly polarized signals from the left hand and right hand circularly polarized signals. Waveguide reject filters may be integrated into each one of the branches of the integrated branch line coupler for isolating the output ports from undesired signals in the core waveguide. The subject technology includes a number of advantageous features. For example, the disclosed system provides a compact and low complexity feed network by the couplers and the rejection filters at the two sides of each branch and also by arranging the transmitter unit and receiver unit on a same core waveguide.

FIG. 1 illustrates a diagram of an example waveguide feed network, according to some aspects of the disclosure. Waveguide feed network 100 includes transmit section 106, receive section 102, and a body section 104. As shown in the figure, body section 104 includes first lower portion 116, first upper portion 118, and second upper portion 120. Transmit section 106 of waveguide feed network 100 includes second lower portion 112 and third upper portion 114. First upper portion 118, third upper portion 114, first lower portion 116, and second lower portion 112 may together include a transmitter unit that is described in more details with respect to FIG. 3 as transmitter unit 300.

Additionally, receive section 102 of waveguide feed network 100 includes third lower portion 122 and fourth upper portion 124. Second upper portion 120, fourth upper portion 124, first lower portion 116, and third lower portion 122 may together include a receive unit that is described in more details with respect to FIG. 6 as receiver unit 600.

Additionally, transmit section 106 of FIG. 1 includes core waveguide 110 having an outer body 108 that is coupled to second lower portion 112. In some embodiments, core waveguide 110 may extend from outer body 108 of transmit section 106, through second lower portion 112 of transmit section 106, and through first lower portion 116 of body section 104 to third lower portion 122 of receive section 102. In some examples, a diameter of core waveguide 110 may change one or more times when passing through outer body 108 to third lower portion 122. In some examples, core waveguide 110 is a circular waveguide. In some other examples, core waveguide 110 is a cruciform waveguide.

Figure 3:
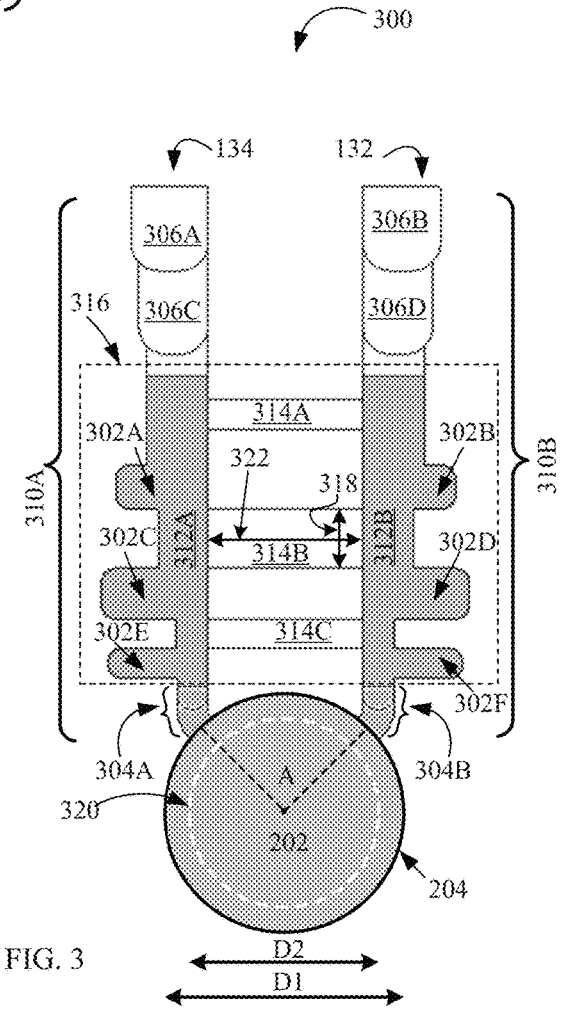
FIG. 3 illustrates a cross sectional diagram of an example transmitter unit, according to some aspects of the disclosure.

In some embodiments, the transmitter unit, shown in FIG. 3, comprises two segments. A first segment of the transmitter unit is included in first upper portion 118 and first lower portion 116 of body section 104 and a second segment of the transmitter unit is included in third upper portion 114 and second lower portion 112 of transmit section 106. Thus, the transmitter unit is formed when transmit section 106 and body section 104 are connected to each other. In some examples, connecting transmit section 106 and body section 104 also forms two input ports 132 and 134. In some examples, the transmitter unit receives a signal through one of input ports 132 and 134 that causes the transmitter unit to transmit a circularly polarized wave through core waveguide 110. In some embodiments, the transmitter unit receives signal through input port 132 and transmits a right hand circularly polarized wave through core waveguide 110. In some embodiments, transmitter unit receives the signal through input port 134 and transmits a left hand circularly polarized wave through core waveguide 110. In some examples, waveguide feed network 100 provides an isolation of better than 25 dB between input ports 132 and 134 of the transmitter unit.

Figure 6:
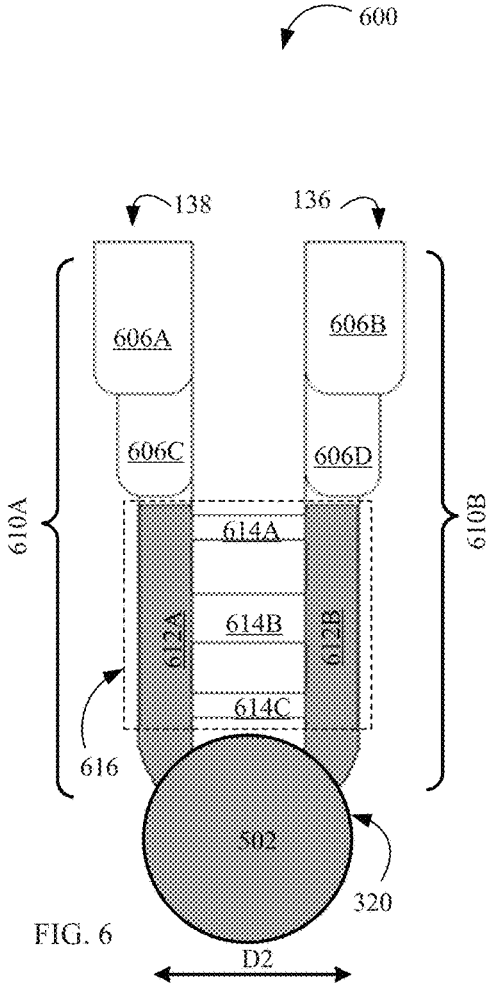
FIG. 6 illustrates a cross sectional diagram of an example receiver unit, according to some aspects of the disclosure.

In some embodiments, the receiver unit, shown in FIG. 6, comprises two segments. A first segment of the receiver unit is included in second upper portion 120 and first lower portion 116 of body section 104 and a second segment of the receiver unit is included in fourth upper portion 124 and third lower portion 122 of receive section 102. Thus, the receiver unit is formed when receive section 102 and body section 104 are connected to each other. In some examples, connecting receive section 102 and body section 104 also forms two output ports 136 and 138. In some examples, the receiver unit receives a circularly polarized wave through core waveguide 110 that causes the receiver unit to generate a signal at one output ports 136 or 138. In some embodiments, the receiver unit receives a right hand circularly polarized wave and generates a signal at output port 136. In some embodiments, the receiver unit receives a left hand circularly polarized wave and generates a signal at output port 138. In some examples, waveguide feed network 100 provides an isolation of better than 25 dB between output ports 136 and 138 of the receive unit. In some examples, waveguide feed network 100 is a compact and low complexity excitation assembly for generating/receiving a circular polarization in/from core waveguide 110. In some embodiments, waveguide feed network 100 is made of aluminum.

Figure 2:
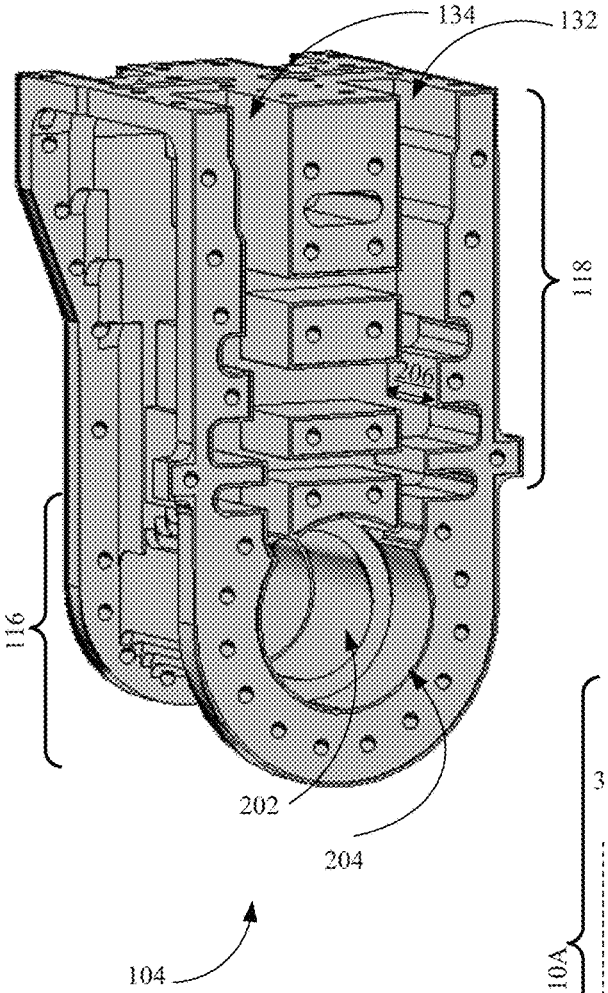
FIG. 2 illustrates a perspective view of a body section of an example waveguide feed network, according to some aspects of the disclosure.

FIG. 2 illustrates a perspective view of a body section of an example waveguide feed network, according to some aspects of the disclosure. As shown, body section 104 includes first lower portion 116 that includes a first segment of core waveguide 202 having perimeter 204. In some embodiments, second lower portion 112 of transmit section 106 includes a complementary second segment of core waveguide 202 that together with the first segment of core waveguide 202, when body section 104 is connected to transmit section 106, form core waveguide 202 of the transmitter unit. Core waveguide 202 is described with respect to FIGS. 7 and 8.

Body section 104 also includes first upper portion 118 that includes a plurality of openings with length 206 that make a first segment of a plurality of rectangular waveguides that are described in more details with respect to FIG. 3 as transmitter unit 300. The first segment of the plurality of rectangular waveguides forms the first segment of the transmitter unit which also includes a first segment of input ports 132 and 134. In some embodiments, third upper portion 114 of transmit section 106 includes a plurality of similar openings that make a complementary second segment of the plurality of rectangular waveguides that form the complementary second segment of the transmitter unit. In some examples, the first segment of a plurality of rectangular waveguides in first upper portion 118 and the second segment of a plurality of rectangular waveguides in third upper portion 114 are symmetrical with respect an outer surface of first upper portion 118 and thus a zero electric field is generated at the outer surface of first upper portion 118. Also, in some examples, a length of the plurality of rectangular waveguides of the transmitter unit is twice length 206.

FIG. 3 illustrates a cross sectional diagram of an example transmitter unit, according to some aspects of the disclosure. A perspective view of transmitter unit 300 is shown with respect to FIG. 7. In some examples, a linearly polarized input signal is received through one of input ports 132 or 134 and circularly polarized signal is generated in core waveguide 202. An operation of transmitter unit 300 is described with respect to FIG. 10. In some examples, transmitter unit 300 is a cross sectional surface through waveguide feed network 100 of FIG. 1, e.g., along a contact surface between body section 104 and transmit section 106 as shown in FIG. 2. Transmitter unit 300 shows core waveguide 202 with perimeter 204 around core waveguide 202 as shown in FIG. 2 as well as a smaller perimeter 320 of the core waveguide at the receiver unit. In some examples, diameter D2 of the core waveguide of waveguide feed network 100 is smaller at the receiver unit compared to diameter D1 at the transmitter unit. In some examples, the smaller diameter of the core waveguide at the receiver provides a higher cut off frequency for the receiver unit compared to the transmitter unit.

Transmitter unit 300 shows two branches 310A and 310B that are coupled to core waveguide 202. Each one of branch 310A or 310B includes waveguide reject filter 312A or 312B that includes one or more stubs, e.g., three stubs. As an example, FIG. 3 shows three single-sides stubs 302A, 302C, and 302E on branch 310A as well as three single-sides stubs 302B, 302D, and 302F on branch 310B. As shown the stubs are protruding outward. In some embodiments, the waveguide filters are waveguide reject filters that are implemented to prevent signals in certain frequency bands to reach input ports 132 and 134 of FIGS. 1, 2, and 3. In some examples, waveguide reject filters 312A or 312B are low pass filters and the sizes of filters 312A and 312B including the sizes of stubs 302A, 302B, 302C, 302D, 302E, and 302F as well as a number of the stubs may be determined based on an allowed wavelength and a rejection band of the waveguide reject filters. In some examples, waveguide reject filters 312A and 312B suppress a signal in a predetermined range that is received via the core waveguide from reaching input ports 132 and 134.

In some examples, the C band is used for receiving and transmitting signals and allowed frequency ranges and stop (e.g., suppressed) frequency ranges of the transmitter unit are predefined. In some examples, a transmitting frequency band includes frequencies 4.120 GHz to 4.20 GHz that may pass from input ports 132 or 134 to core waveguide 202. The receiving frequency band includes frequencies 6.345 GHz to 6.425 GHz that are suppressed, e.g., by more than 55 dB, from reaching input ports 132 or 134 from the core waveguide. Thus, an isolation of better than 55 dB may be achieved for input ports 132 and 132 from undesired signals in the core waveguide that are in the receiving frequency band.

Figure 4:
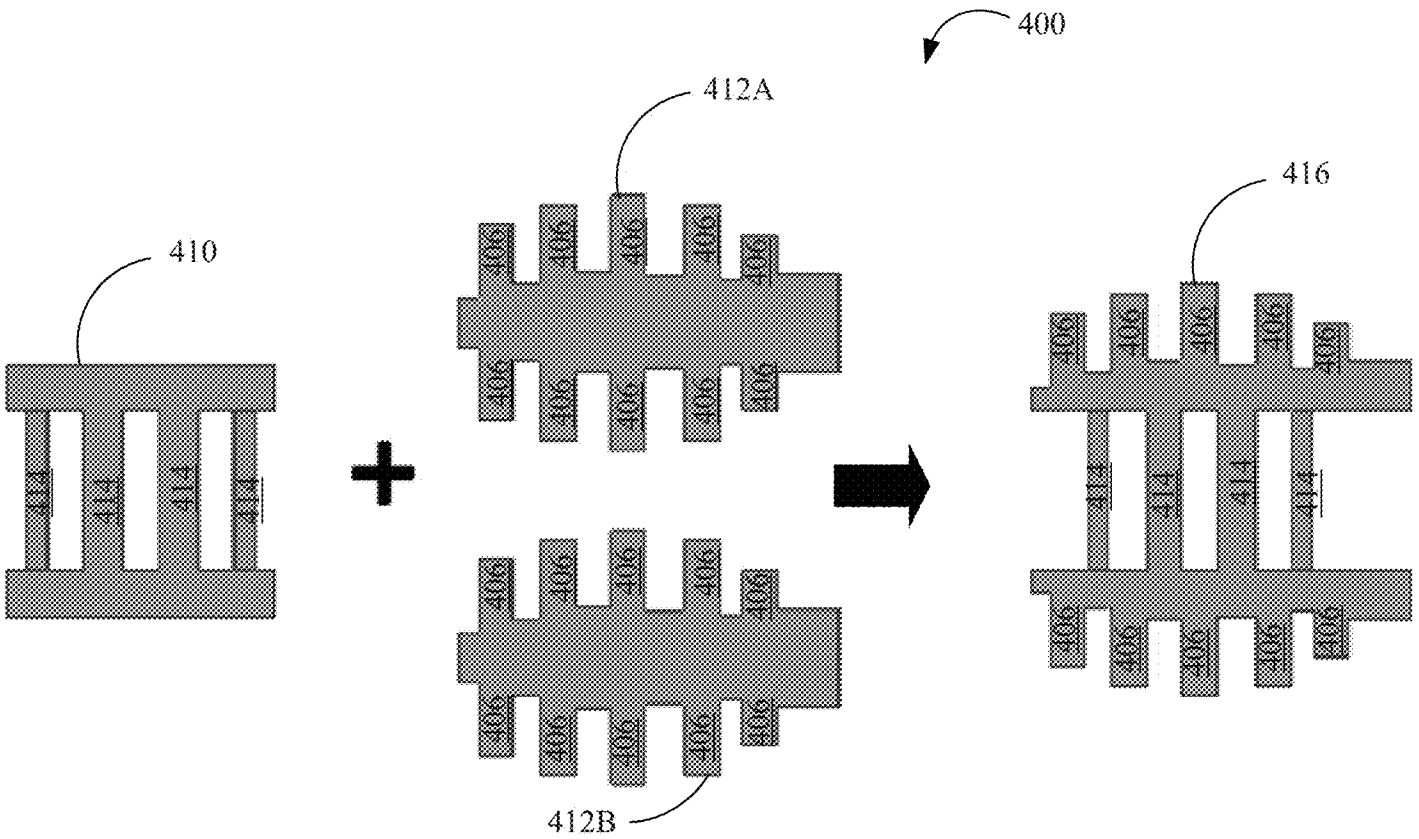
FIG. 4 illustrates components of an example integrated branch line coupler, according to some aspects of the disclosure.

As shown, a free end of stubs 302A, 302B, 302C, 302D, 302E, and 302F may be short-circuited. Then an input impedance of a short-circuited stub is purely reactive; either capacitive or inductive, depending on the electrical length and width of the stubs and a wavelength of signal passing through waveguide reject filters 312A or 312B. Stubs may thus function as capacitors and inductors in waveguide reject filters 312A or 312B and may be used to tune a bandwidth of waveguide reject filters 312A or 312B. As shown in FIG. 4, more than three stubs, e.g., five stubs may be integrated into the waveguide reject filters of each branch to further shape a frequency response of waveguide reject filters.

Additionally, transmitter unit 300 shows two evanescent waveguides 304A and 304B that are coupled between branches 310A and 310B and core waveguide 202. In some examples, a size of evanescent waveguides 304A and 304B are adjusted such an insertion loss between core waveguide 202 and the waveguide reject filters 312A and 312B of branches 310A and 310B are less than a predetermined level, e.g., less than 0.05 dB, in each branch. In some embodiments, evanescent waveguides 304A and 304B of first and second branches 310B and 310A of transmitter unit 300 have predetermined angles, e.g., 45 degrees, when coupled to the core waveguide. The 45-degree turns of evanescent waveguides 304A and 304B may cause a supposed continuation of branches 310A and 310B to intersect each other at a center of core waveguide 202 with an angle A equal to 90 degrees. Thus, the ends of the branches 310A and 310B coupled to the core waveguide 202 may become perpendicular to each other. Additionally, the 45-degree turn may allow integrated branch line coupler 316 to stay close to core waveguide 502, reducing a size and mass of transmitter unit 300 to make it compact.

In addition, transmitter unit 300 shows transformers 306A, 306B, 306C, and 306D on branches 310A and 310B. The transformers have dimensions that are determined based on a frequency range of the transmitted signals that may be input at input ports 132 and 134 and to minimize an insertion loss of the transmitter unit. In some embodiments, the one or more transformers of each branch 310A or 310B are quarter wave transformers that are configured to provide a change of wavelength for matching. By using transformers 306A, 306B, 306C, and 306D, to change the wavelength, branches 310A or 310B may match to a transmitter circuit that can be coupled to input ports 132 and 134. In some examples, quarter wave transformer WR229 may be used.

In some examples, waveguide reject filters 312A and 312B of branches 310A and 310B of transmitter unit 300 are low pass filters. Waveguide reject filters 312A and 312B may transmit received input signals at a first frequency, e.g., in a range between 4.120 GHz and 4.20 GHz, from input ports 132 and 134 to core waveguide 202. The waveguide reject filters may reject a second signal at a second frequency greater than the first frequency, e.g., in a range between 6.345 GHz and 6.425 GHz. Thus, waveguide reject filters 312A and 312B may prevent a received second signal in the second frequency from core waveguide 202 to reach input ports 132 and 134.

Transmitter unit 300 shows integrated branch line coupler 316 that includes couplers 314A, 314B, and 314C that inwardly couple branches 310A and 310B. Integrated branch line coupler 316 also includes waveguide reject filters 312A and 312B that are described above. A number, size, and location of couplers 314A, 314B, and 314C may be selected to create left hand circular polarization as well as right hand circular polarization signals in core waveguide 202. The circular polarization signals are created based on the linearly polarized signals that are received from input ports 132 and 134 of branches 310A and 310B. In some examples, waveguide reject filters 312A or 312B have an inner face and an outer face. In some examples, couplers 314A, 314B, and 314C are coupled between the inner face of waveguide reject filters 312A or 312B. In some embodiments, integrated branch line coupler 316 provides splitting a power by 3 dB and a 90 degrees phase shift to generate a circular polarization mode from a linear polarization mode. In some examples, width 322 of couplers 314A, 314B, and 314C can provide the 90 degrees phase shift. Waveguide reject filters 312A or 312B of integrated branch line coupler 316 may isolate an unwanted circular polarization mode to get to input ports 132 or 134.

In some examples, integrated branch line coupler 316 may also provide a predetermined axial ratio, e.g., 0.40 dB axial ratio, over a bandwidth of up to 9 percent, between the left hand and right hand circularly polarized signals. In some embodiments, a distance between couplers 314A, 314B, and 314C, depends on diameter D1 of core waveguide 202. In some examples, couplers 314A, 314B, and 314C are e-plane couplers and a height of the couplers may determine an amount of energy that may be transferred between the branches. As an example, height 318 of coupler 314B determines an amount of energy that may be transferred between the branches 310A and 310B. Integrated branch line coupler 316 is described with respect to FIG. 4.

Additionally, in some examples, stubs 302A, 302B, 302C, 302D, 302E, and 302F are coupled to and extended from the outer face of waveguide reject filters 312A or 312B. In some embodiments, the one or more single-sided stubs 302A, 302B, 302C, 302D, 302E, and 302F of waveguide reject filters 312A and 312B correspond to one or more cascaded filter sections. In some embodiments as shown in FIG. 3, one or more single-sided stubs 302A, 302B, 302C, 302D, 302E are coupled outwardly to waveguide reject filters 312A or 312B. Additionally, couplers 314A, 314B, and 314C are coupled inwardly to waveguide reject filters 312A or 312B in between a location of the one or more single-sided stubs. In some examples, waveguide reject filters 312A and 312B allows a signal being in frequency range 4.12 GHz to 4.2 GHz to pass, e.g., from input ports 132 and 134 to core waveguide 202. In some examples, waveguide reject filters 312A and 312B suppresses a signal being in frequency range 6.345 GHz to 6.425 GHz to pass, e.g., from core waveguide 202 to any of input ports 132 and 134, and provide at least a 35 dB isolation.

In some embodiments, integrated branch line coupler 316 generates, at core waveguide 202, one or both of a right hand circularly polarized signal and a left hand circularly polarized signal from a linearly polarized signal. In some embodiments, transmitter unit 300 receives an input signal at a first frequency from input port 132 of first branch 310B and generates a right hand circularly polarized signal at the first frequency in core waveguide 202. In some embodiments, transmitter unit 300 receives an input signal at a first frequency from input port 134 of second branch 310A and generates a left hand circularly polarized signal at the first frequency in the core waveguide.

FIG. 4 illustrates components of an example integrated branch line coupler, according to some aspects of the disclosure. Diagram 400 of FIG. 4 shows integrated branch line coupler 416 that is consistent with integrated branch line coupler 316 of FIG. 3. In some embodiments, integrated branch line coupler 416 is an integration of branch line coupler 410 and portions of corrugated low pass filters 412A and 412B. Branch line coupler 410 may have a plurality of couplers 414. Corrugated low pass filters 412A and 412B may have a plurality of stubs 406. Integrated branch line coupler 416 may be viewed as an integration of branch line coupler 410, upper half of corrugated low pass filter 412A, and lower half of corrugated low pass filter 412B. Alternatively, integrated branch line coupler 416 may be viewed as an integration of branch line coupler 410 and one of the corrugated low pass filters 412A or 412B. In some embodiments, the plurality of couplers 414 and the plurality of stubs 406 do not face each other when coupled in integrated branch line coupler 416. In some examples, integrated branch line coupler 416 performs functions of filtering as well as dividing power and providing phase shift to create linearly polarized signals.

Figure 5:
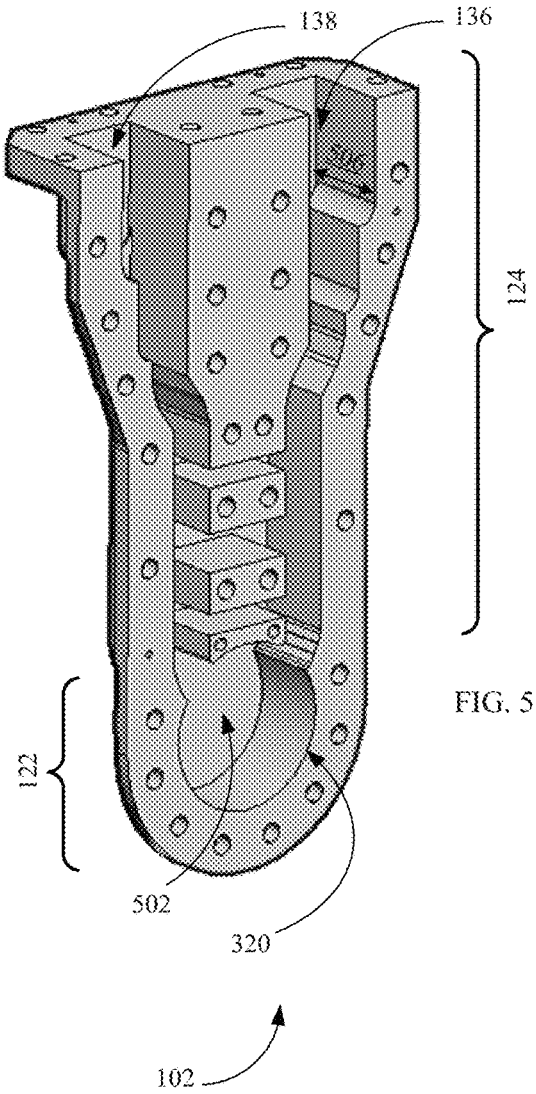
FIG. 5 illustrates a perspective view of a receive section of an example waveguide feed network, according to some aspects of the disclosure.

FIG. 5 illustrates a perspective view of a receive section of an example waveguide feed network, according to some aspects of the disclosure. As shown, receive section 102 includes third lower portion 122 that includes core waveguide 502 having perimeter 320. In some embodiments, third lower portion 122 of receive section 102 includes a complementary second segment of core waveguide 502 that together with the first segment of core waveguide 502 form core waveguide 502 of the receiver unit. In some examples, a diameter of core waveguide 110 changes, e.g., is reduced, between the transmitter unit and the receiver unit such that core waveguide 502, which is a portion of core waveguide 110, has a smaller diameter compared to anther portion of core waveguide 110, which is core waveguide 202. Core waveguides 202 and 502 are described in more details with respect to FIGS. 7 and 8.

Receive section 102 also includes fourth upper portion 124 that includes a plurality of openings with length 506 that make a first segment of a plurality of rectangular waveguides that are described in more details with respect to FIG. 6 as receiver unit 600. The first segment of the plurality of rectangular waveguides forms the first segment of the receiver unit which also includes a first segment of output ports 136 and 138. In some embodiments, second upper portion 120 of body section 104 includes a plurality of similar openings that make a complementary second segment of the plurality of rectangular waveguides that form the complementary second segment of the receiver unit. In some examples, the first segment of a plurality of rectangular waveguides in fourth upper portion 124 and the second segment of a plurality of rectangular waveguides in second upper portion 120 are symmetrical with respect to an outer surface of fourth upper portion 124 and thus a zero electric field is generated at the outer surface of fourth upper portion 124. In addition, in some examples, a length of the plurality of rectangular waveguides of the transmitter unit is twice length 506.

FIG. 6 illustrates a cross sectional diagram of an example receiver unit, according to some aspects of the disclosure. A perspective view of receiver unit 600 is shown with respect to FIG. 7. In some examples, receiver unit 600 shows a cross sectional surface through waveguide feed network 100 of FIG. 1, e.g., along a contact surface between body section 104 and receive section 102 as shown in FIG. 2. Receiver unit 600 shows core waveguide 502 with perimeter 320 around core waveguide 502 as shown in FIG. 5. In some examples, core waveguide 502 has diameter D2 shown also in FIG. 3.

In some examples, circularly polarized signals are received through core waveguide 502 via branches 610A and 610B that are coupled to core waveguide 502. The received signals pass through filters 612A and 612B as well as couplers 614A, 614B, and 614C, and generate a linearly polarized signal. The linearly polarized signal may be generated at one of output ports 136 or 138 depending on the signal being right hand circularly polarized or left hand circularly polarized, respectively. In some examples, an isolation of better than 25 dB is provided between output ports 136 and 138. In some examples, waveguide reject filters 612A and 612B allows a signal being in frequency 6.345 GHz to 6.425 GHz to pass, e.g., from core waveguide 502 to one of output ports 136 and 138. In some examples, waveguide reject filters 612A and 612B suppresses a signal being in frequency range 4.12 GHz to 4.2 GHz to pass, e.g., from core waveguide 502 to any of output ports 136 and 138, and provides at least 55 dB isolation.

Receiver unit 600 includes two branches 610A and 610B that are coupled to core waveguide 502. Each one of branch 610A or 610B includes waveguide reject filters 612A or 612B. Waveguide reject filters 612A and 612B may have dimensions that are determined based on a frequency of the transmitted signals, and may act as transmit reject filters. Waveguide filters 612A and 612B may also be called waveguide reject filters 612A and 612B that suppress rectangular mode TE10 in the frequency range of 4.120 GHz and 4.20 GHz. Thus, waveguide reject filters 612A and 612B may perform a filtering, e.g., high pass filtering, to suppress the transmitter signals and further prevent the transmitter signals from reaching output ports 136 or 138 of the receiver unit.

Receiver unit 600 shows integrated branch line coupler 616 that includes couplers 614A, 614B, and 614C that inwardly couples branches 610A and 610B. Integrated branch line coupler 616 also includes waveguide reject filters 612A or 612B that are described above. A number, size, and location of the couplers 614A, 614B, and 614C may be selected to transform left hand circular polarization as well as right hand circular polarization signals at core waveguide 502 to linearly polarized signals at output ports 136 and 138 of branches 610A and 610B. In some examples, a distance between couplers 614A, 614B, and 614C, depends on diameter D2 of core waveguide 502. In some examples, couplers 614A, 614B, and 614C are e-plane couplers.

In some embodiments, the waveguide filters, e.g., waveguide reject filters 612A or 612B have an inner face and an outer face. In some examples, integrated branch line coupler 616 comprises couplers 614A, 614B, and 614C that are coupled between the inner face of the waveguide reject filters 612A or 612B. As described, integrated branch line coupler 616 may divide power and generate phase shift to create linearly polarized signals from circularly polarized signals. In some embodiments, couplers 614A, 614B, and 614C of integrated branch line coupler 616 generates a linearly polarized signal at a first frequency from a circularly polarized signal at the first frequency. In some embodiments, the integrated branch line coupler provides, splitting a power by 3 dB, causing 90 degrees phase shift to generate a linear polarization from a circular polarization mode, and isolating a signal to get to the other port.

In addition, receiver unit 600 shows transformers 606A, 606B, 606C, and 606D on branches 610A and 610B. The transformers have dimensions that are determined based on a frequency of the received signals from the core waveguide and to minimize an insertion loss of the receiver unit at output ports 136 and 138. In some embodiments, the one or more transformers of each branch 610A or 610B are quarter wave transformers that are configured to provide a change of wavelength for matching. By using transformers 606A, 606B, 606C, and 606D, to change wavelength, branches 610A or 610B may match to a receiver circuit that can be coupled to output ports 136 and 138. In some examples, quarter wave transformer WR137 may be used.

In some examples, the circularly polarized signal is received from core waveguide 502 and the linearly polarized signal is generated at an output of waveguide reject filters 612A and 612B that is coupled to a transformer. In some examples, receiver unit 600 receives a right hand circularly polarized signal at a first frequency from core waveguide 502 and generates an output signal at the first frequency at output port 136 of second branch 610B. In some examples, receiver unit 600 receives a left hand circularly polarized signal at a first frequency from core waveguide 502 and generates an output signal at the first frequency at output port 138 of first branch 610A. In some embodiments, branches 610A or 610B have a 45-degree turn, e.g., bend, at an end that attaches to core waveguide 502. The 45-degree turn may allow integrated branch line coupler 616 to stay close to core waveguide 502, reducing a size and mass of receiver unit 600 and creating a compact receiver unit. In some examples, placing integrated branch line coupler 616 close to core waveguide 502 may allow more effective impedance matching between core waveguide 502 and receiver unit 600.

Figure 7:
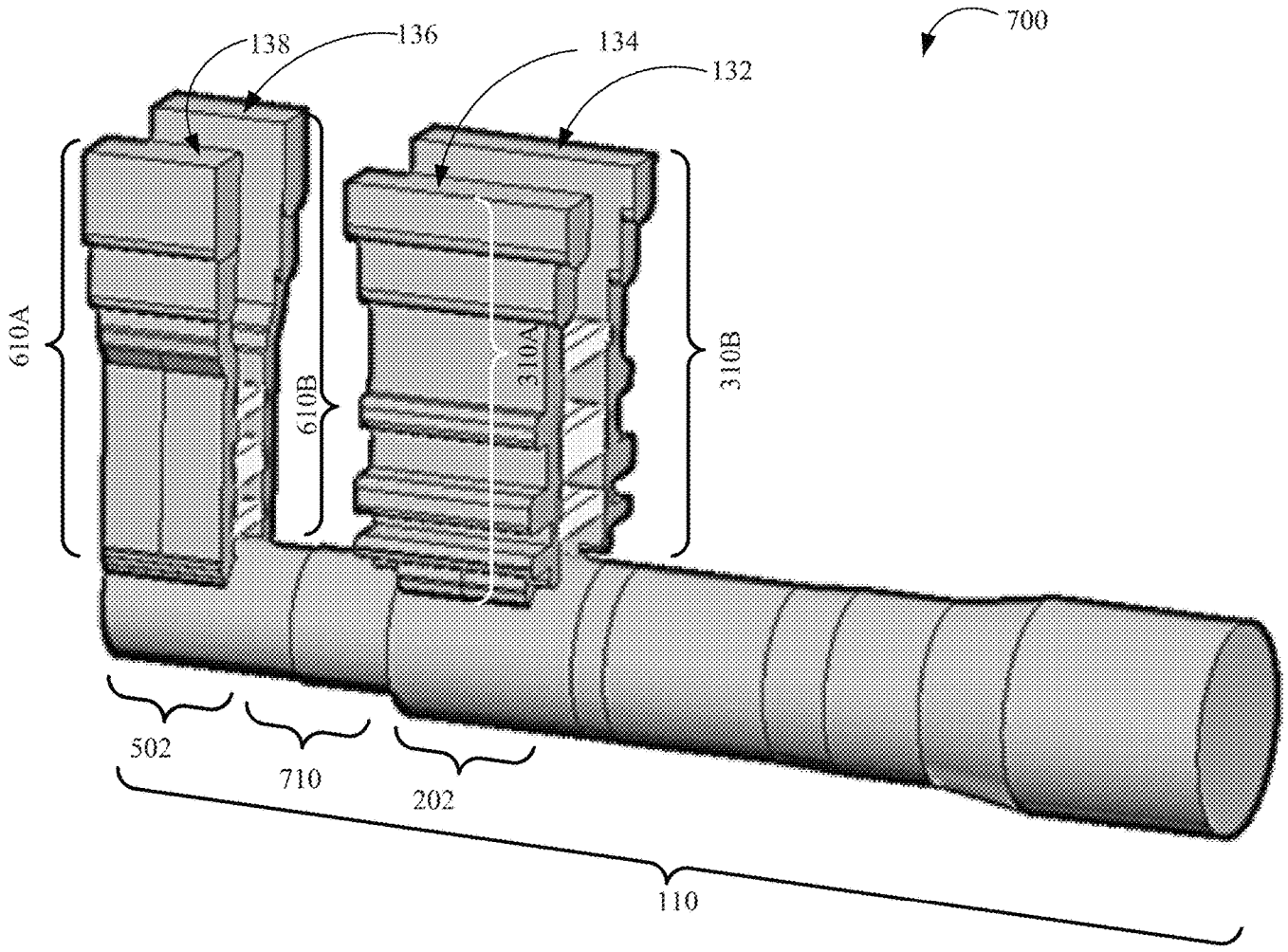
FIG. 7 illustrates a perspective view of an example waveguide feed network, according to some aspects of the disclosure.

FIG. 7 illustrates a perspective view of an example waveguide feed network, according to some aspects of the disclosure. Returning back to FIGS. 1-3, diagram 700 of FIG. 7 shows core waveguide 202 of the transmitter unit. Core waveguide 202 is consistent with a portion of core waveguide 110 of FIG. 1 that is coupled to branches 310A and 310B. FIG. 7 also shows core waveguide 502 of the receiver unit that is consistent with a portion of core waveguide 110 of FIG. 1 that is coupled to branches 610A and 610B. Core waveguides 202 and 502 are coupled together via core waveguide 710 extended between the transmitter unit and receiver unit inside first lower portion 116 of body section 104. A diameter of core waveguides 202, 710, and 502 are described with respect to FIG. 8. Diagram 700 also shows core waveguide 110 that is extended outward. In some examples, waveguide feed network 100 receives signals from input ports 132 and 134 and transmits circularly polarized signals through core waveguide 110. In some examples, waveguide feed network 100 receives signals from core waveguide 110 and provides output signals through output ports 136 and 138. Diagram 700 additionally shows a perspective view of branches 310A and 310B of the transmitter unit that include input ports 132 and 134 and a perspective view of branches 610A and 610B of the receiver unit that include output ports 136 and 138.

Figure 8:
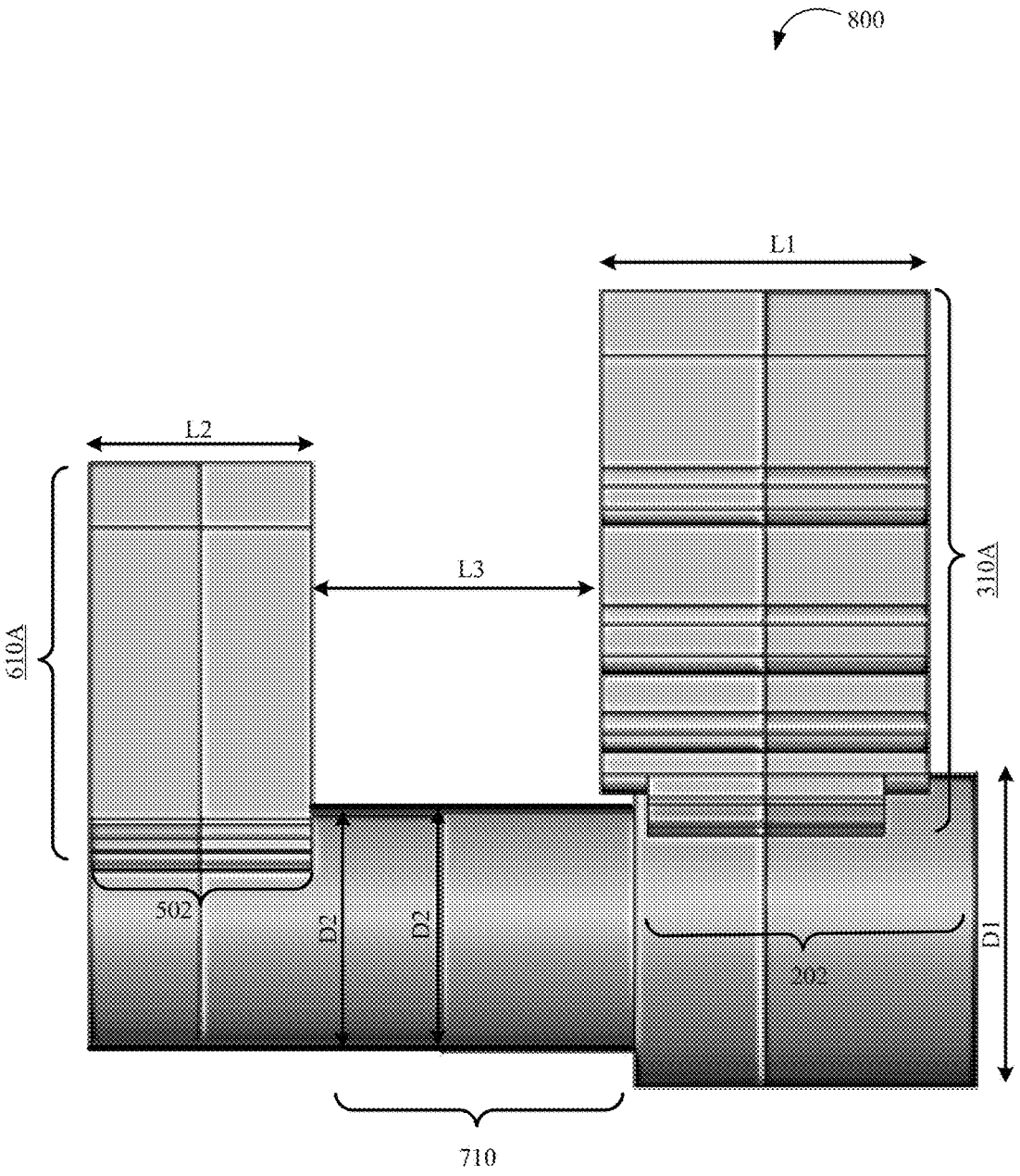
FIG. 8 illustrates a side view of an example waveguide feed network, according to some aspects of the disclosure.

FIG. 8 illustrates a side view of an example waveguide feed network, according to some aspects of the disclosure. In some examples, diagram 800 of FIG. 8 is a side view of diagram 700 of FIG. 7 that shows a side view of branch 310A of the transmitter unit and a side view of branch 610A of the receiver unit. Diagram 800 also includes core waveguide 202 and core waveguide 502 coupled together via core waveguide 710. In some embodiments as shown in diagram 800, diameter D2 of core waveguide 502 of the receiver unit is smaller than diameter D1 of core waveguide 202 of the transmitter unit. Consequently, core waveguide 502 of the receiver unit may have a higher cutoff frequency for waveguide propagation modes compared to the cutoff frequency of core waveguide 202 of the transmitter unit. In some examples, diameter D1 of core waveguide 202 is reduced through core waveguide 710 to match diameter D2 of core waveguide 502 in one or more steps, e.g., in one step. In some examples, the transmitter unit has length L1, the receiver unit has length L2, and the transmitter unit and the receiver unit are separated by length L3.

In some embodiments, dimensions of waveguide feed network 100 depends on a frequency of operation of waveguide feed network 100. In some embodiments, transmitting and receiving frequencies are selected in C band. In some examples, a transmitting frequency is in a range F1=4.12 GHz to F2=4.2 GHz and a receiving frequency is in a range F3=6.345 GHz to F4=6.425 GHz. In some embodiments, D1 is selected in a first range between 1.70 inches and 1.73 inches, e.g., D1 is selected at 1.72 inches. By selecting D1 in the first range, the cutoff frequency for TE21 mode in core waveguide 202 stays between 6.64 GHz and 6.76 GHz. Thus, the higher frequency F4 is sufficiently, e.g., by at least 1 percent below the lower cutoff frequency. Thus, TE21 mode may not propagate in the core waveguide 202 of waveguide feed network 100 in the transmitting frequency range of F1 to F2 or receiving frequency range of F3 to F4. D2 being smaller than D1, TE21 mode may not also propagate in the core waveguide 502 in the transmitting frequency range of F1 to F2 or receiving frequency range of F3 to F4.

The cutoff frequency for TE11 mode in core waveguide 202, having diameter D in the first range, may be between 4.0 GHz and 4.07 GHz. Thus, the transmitting frequencies in the transmitting frequency range of F1=4.12 GHz to F2=4.2 GHz may propagate from the transmitter unit 300 via TE11 mode in the core waveguide 202. The lower frequency F1 is at least above the higher cutoff frequency of 4.07 GHz by more than 1 percent. In some examples, L1 is selected between 1.44 inches and 1.835 inches, e.g., 1.806 inches, such that no TE20 or TE30 modes can propagate in rectangular waveguides of waveguide reject filters 312A and 312B. By selecting L1 between 1.44 inches and 1.835 inches, TE10 mode is sufficiently out of a cutoff frequency in the rectangular waveguides of transmitter unit 300 and thus may propagate through transmitter unit 300 to core waveguide 202. In some examples, D2 is selected between 1.2 inches and 1.54 inches, e.g., 1.354 inches, such that in core waveguides 710 and 502 the TE11 mode is sufficiently in cutoff for F2 and clearly for F1. D2 is selected such that F3 and clearly F4 are sufficiently out of cutoff for TE11 mode in core waveguides 710 and 502. In some examples, L3 is selected longer than 1.55 inches, e.g., 1.598 inches, such that a greater that 40 dB suppression may be obtained for TM01 mode in the core waveguide between the transmitter unit and receiver unit.

Figure 9A:
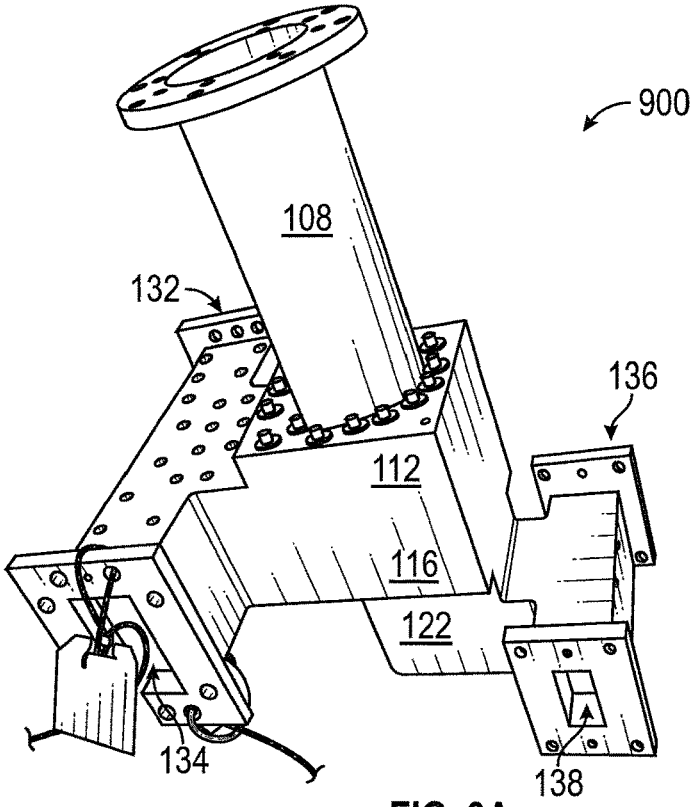
FIG. 9A illustrates an image of an example waveguide feed network, according to some aspects of the disclosure.

FIG. 9A illustrates an image of an example waveguide feed network, according to some aspects of the disclosure. Returning back to FIG. 1, image 900 of FIG. 9A shows an example manufactured body of waveguide feed network 100. Image 900 shows outer body 108 of core waveguide 110, second lower portion 112, first lower portion 116, and third lower portion 122. Image 900 also shows input ports 132 and 134 as well as output port 136 and 138. In some examples as shown, the transmitter unit and the receiver unit are not at a same side of waveguide feed network 100 and may even be at the opposite sides. In some examples as shown, input ports 132 and 134 as well as output port 136 and 138 are at opposite sides of waveguide feed network 100 and the openings to the output ports and input ports may have different orientations.

Figure 9B:
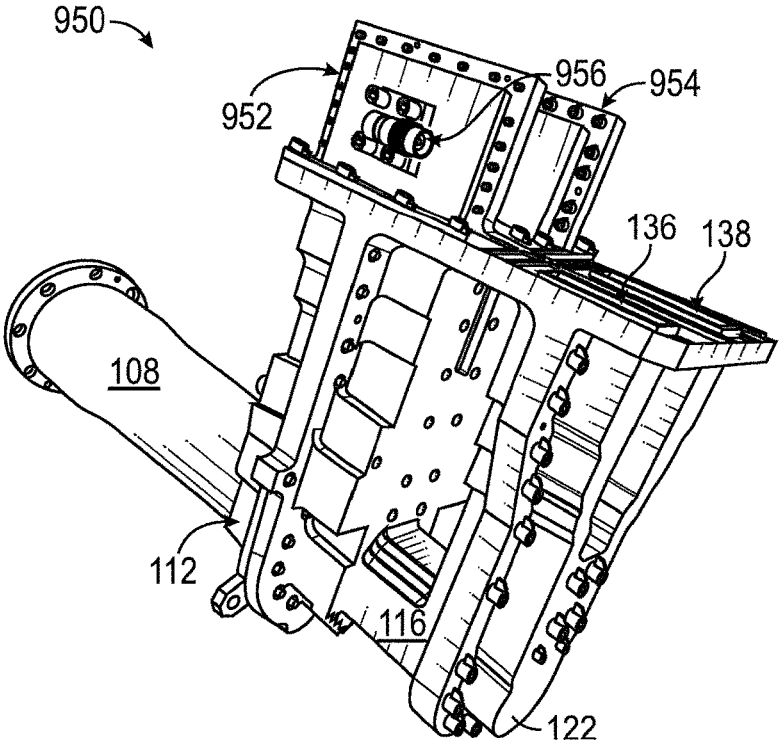
FIG. 9B illustrates an image of an example waveguide feed network, according to some aspects of the disclosure.

FIG. 9B illustrates an image of an example waveguide feed network, according to some aspects of the disclosure. Returning to FIG. 1, image 950 of FIG. 9B shows an example manufactured body of waveguide feed network 100. Image 950 shows outer body 108 of core waveguide 110, second lower portion 112, first lower portion 116, and third lower portion 122. Image 950 also shows output port 136 and 138. Input ports 132 and 134 are respectively coupled through waveguides 952 and 954 to transmitter circuits (not shown) such the input signal may be connected through connection 956.

In some embodiments and referring back to FIGS. 1 and 3, a plurality of transmitter units 300 may be included in waveguide feed network 100. The plurality of transmitter units 300 may be coupled to core waveguide 110 and may operate at a plurality of first distinct transmitting frequencies. Also, a plurality of receiver units may be included in waveguide feed network 100. The plurality of receiver units 600 may be coupled to core waveguide 110 and may operate at a plurality of second distinct receiving frequencies different from and greater that the plurality of first distinct transmitting frequencies.

In some embodiments and returning back to FIG. 1, core waveguide 110 is designed to suppress a propagation of TE21 in the core waveguide. A diameter of the core waveguide is reduced from the transmitter unit to the receiver unit to suppress transmitting frequencies of the transmitter unit in TE11 mode from reaching the receiver. Reduced diameter D2 of core waveguide 110 at the receiver unit 600 and length L3 of core waveguide 110 between transmitter unit 300 and receiver unit 600 may also prevents the TM01 mode from reaching the receiver unit. In some examples, at highest receiving frequency in the range of F3 to F4, TM01 mode is reduced in the core waveguide by more than 40 dB to prevent disrupting an antenna pattern.

Figure 10:
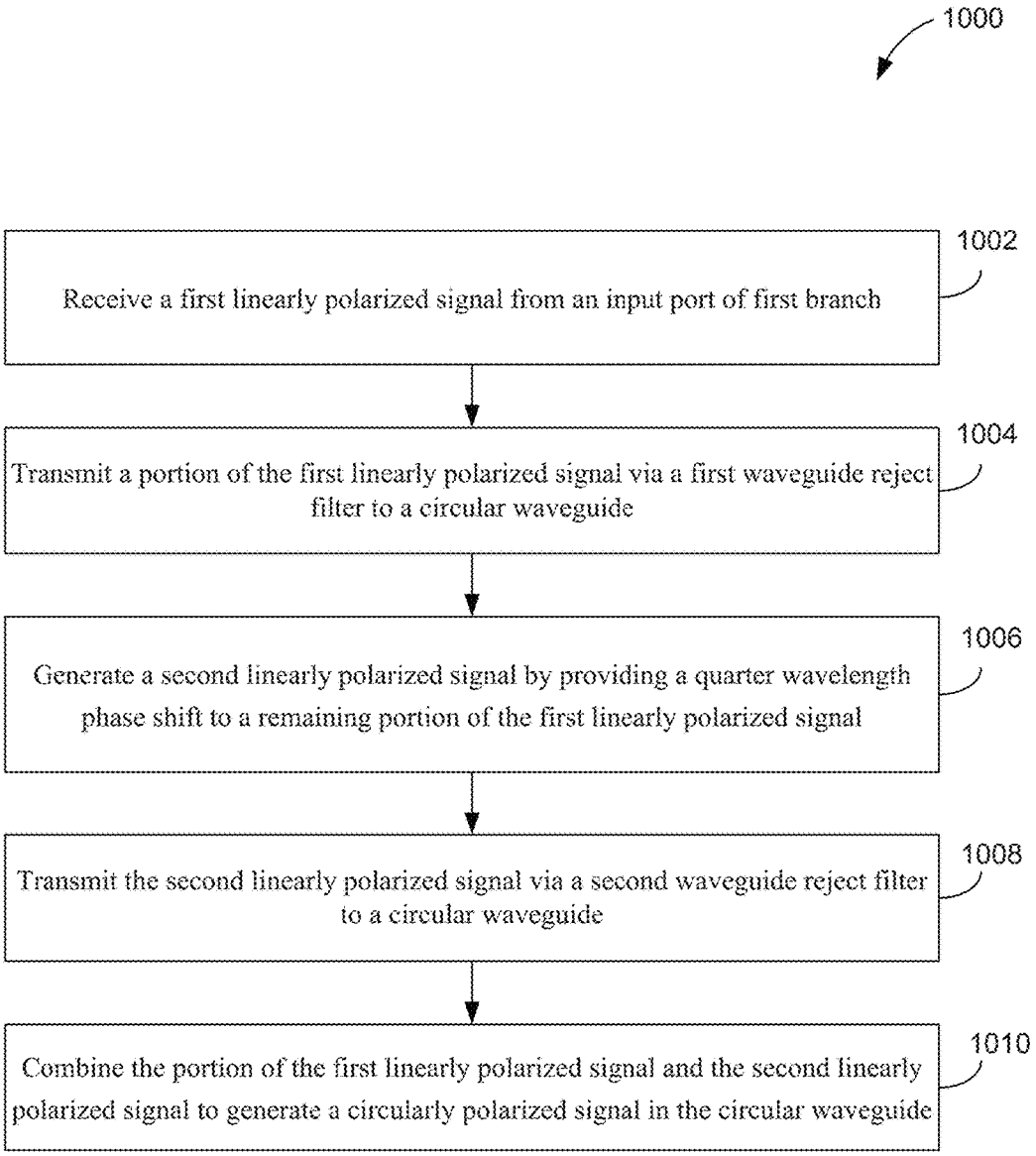
FIG. 10 illustrates a flow diagram of an example method of operation of a waveguide feed network, according to some aspects of the disclosure.

FIG. 10 illustrates a flow diagram of an example method of operation of a waveguide feed network, according to some aspects of the disclosure. Notably, one or more steps of method 1000 described herein may be omitted, performed in a different sequence, and/or combined with other methods for various types of applications contemplated herein. Method 1000 can be performed to operate transmitter unit 300 of FIG. 3. As shown in FIG. 2, transmitter unit 300 may be coupled between two input ports 132 and 134 and core waveguide 202 and may receive linearly polarized input signals from the input ports. Transmitter unit 300 may generate circularly polarized signal in core waveguide 202.

As show in FIG. 10, at step 1002, a transmitter unit receives a first linearly polarized signal by an input port. In some examples as shown in FIG. 3, the transmitter unit includes two branches each having an input port. In some examples, the transmitter unit receives the first linearly polarized signal from input port 132 of first branch 310B.

At step 1004, a portion of the first linearly polarized signal is transmitted via a first waveguide reject filter to a circular waveguide. In some examples, a first half of the first linearly polarized signal is transmitted to the circular waveguide. In some embodiments, the portion of the first linearly polarized signal is transmitted through first waveguide reject filter 312B of first branch 310B to core waveguide 202 that may be a circular waveguide. In some examples, first waveguide reject filter 312B is part of integrated branch line coupler 316 that is located in first branch 310B. In some embodiments, as shown in FIG. 3, one or more transformers 306B and 306D are coupled between input port 132 and first waveguide reject filter 312B to provide a change of wavelength for matching. In some embodiments an evanescent waveguide, e.g., evanescent waveguide 304B of FIG. 3, couples first waveguide reject filter 312B to core waveguide 202.

At step 1006, a second linearly polarized signal is generated by providing a quarter wavelength phase shift to a remaining portion of the first linearly polarized signal. In some embodiments, the a quarter wavelength phase shift is provided by a transmission of the remaining portion of the first linearly polarized signal to second branch 310A through couplers 314A, 314B, and 314C of integrated branch line coupler 316. Couplers 314A, 314B, and 314C are inwardly coupled between first waveguide reject filter 312B and second waveguide reject filter 312A. In some examples, a second half of the first linearly polarized signal that is transmitted to second waveguide reject filter 312A receives 90 degrees phase shift.

At step 1008, the second linearly polarized signal is transmitted via a second waveguide reject filter to a circular waveguide. In some examples, the second linearly polarized signal is generated from the second half of the first linearly polarized signal. The second half of the first linearly polarized signal is transmitted through couplers 314A, 314B, and 314C of integrated branch line coupler 316 and receives 90 degrees phase shift. In some embodiments, as shown in FIG. 3, the second linearly polarized signal is transmitted through second waveguide reject filter 312A of second branch 310A to core waveguide 202. In some examples, second waveguide reject filter 312A is part of integrated branch line coupler 316 that is located in second branch 310A. In some embodiments, an evanescent waveguide, e.g., evanescent waveguide 304A of FIG. 3, couples second waveguide reject filter 312A to core waveguide 202.

At step 1010, the portion of the first linearly polarized signal and the second linearly polarized signal are combined to generate a circularly polarized signal in the circular waveguide. As shown in FIG. 3, first branch 310B and second branch 310A are coupled to core waveguide 202 via evanescent waveguides 304A and 304B at separate predefined locations of core waveguide 202 to generate the circularly polarized signal in core waveguide 202. In some examples, when the first linearly polarized signal is received through input port 132, a right hand circularly polarized signal is generated in core waveguide 202 and additionally input port 134 is isolated by better than 25 dB. In some examples, when the first linearly polarized signal is received through input port 134, a left hand circularly polarized signal is generated in core waveguide 202 and additionally input port 132 is isolated by better than 25 dB.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. A feed network comprising:

a first transmitter unit that comprises:

a first branch having a first input port and a second branch having a second input port;

a first integrated branch line coupler coupling the first branch and the second branch, the first integrated branch line coupler comprising:

a first waveguide reject filter in the first branch comprising a first end and a second end and an outer face and an inner face, wherein the first end of the first waveguide reject filter is coupled to the first input port;

a second waveguide reject filter in the second branch comprising a first end and a second end and an outer face and an inner face, wherein the first end of the second waveguide reject filter is coupled to the second input port;

a first group of one or more couplers coupled between the inner face of the first waveguide reject filter and the inner face of the second waveguide reject filter; and a first group of one or more single-sided stubs protruding outwardly from the outer face of the first waveguide reject filter and a second group of one or more single-sided stubs protruding outwardly from the outer face of the second waveguide reject filter; and a core waveguide coupled to the first branch via the second end of the first waveguide reject filer and to the second branch via the second end of the first waveguide reject filer;

wherein the first transmitter unit is configured to receive a linearly polarized signal from one of the first input port or the second input port and to generate a circularly polarized signal in the core waveguide.

2. The feed network of claim 1, wherein the core waveguide is a circular waveguide.

3. The feed network of claim 1, wherein the first group of one or more couplers of the first transmitter unit are configured to generate a 90 degree phase shift when transferring a linearly polarized signal between the first and second branches.

4. The feed network of claim 1, wherein the first transmitter unit is configured to receive an input signal at a first frequency from the first input port of the first branch and to generate a right hand circularly polarized signal at the first frequency in the core waveguide.

5. The feed network of claim 4, wherein the first transmitter unit is configured to receive an input signal at a first frequency from the second input port of the second branch and to generate a left hand circularly polarized signal at the first frequency in the core waveguide.

6. The feed network of claim 1, wherein the first group of one or more single-sided stubs correspond to a first group of one or more cascaded filter sections in the first waveguide reject filter, and wherein the second group of one or more single-sided stubs correspond to a second group of one or more cascaded filter sections in the second waveguide reject filter.

7. The feed network of claim 1, wherein the first and second waveguide reject filters of the first transmitter unit are low pass filters that are configured to transmit a received input signal at a first frequency from the first or second input port and to reject a second signal received from the core waveguide at a second frequency greater than the first frequency.

8. The feed network of claim 7, further comprising:

a first receiver unit configured to be coupled to the core waveguide to receive a circularly polarized signal from the core waveguide, the first receiver unit comprising:

a third branch having a first output port and a fourth branch having a second output port;

a second integrated branch line coupler coupling the third branch and the fourth branch, the second integrated branch line coupler comprising:

a third waveguide reject filter in the third branch comprising a first end and a second end and an outer face and an inner face, wherein the first end of the third waveguide reject filter is configured to be coupled to the core waveguide and the second end of the third waveguide reject filter is configured to be coupled to the first output port;

a fourth waveguide reject filter in the fourth branch comprising a first end and a second end and an outer face and an inner face, wherein the first end of the fourth waveguide reject filter is configured to be coupled to the core waveguide and the second end of the fourth waveguide reject filter is configured to be coupled to the second output port; and a second group of one or more couplers coupled between the inner face of the third waveguide reject filter and the inner face of the fourth waveguide reject filter;

wherein the first receiver unit is configured to receive a circularly polarized signal of the second frequency via the first ends of the third and fourth waveguide reject filters from the core waveguide and to generate a linearly polarized signal of the second frequency at one of the first output port or the second output port.

9. The feed network of claim 8, further comprising:

one or more transmitter units in addition to the first transmitter unit, wherein each one of the first transmitter unit and the one or more transmitter units are coupled to the core waveguide and are configured to operate at two or more distinct transmitting frequencies; and one or more receiver units in addition to the first receiver unit, wherein each one of the first receiver unit and the one or more receiver units are coupled to the core waveguide and are configured to operate at two or more distinct receiving frequencies different from and greater that the distinct transmitting frequencies.

10. The feed network of claim 8, wherein a diameter of the core waveguide is selected to suppress a propagation of TE21 mode in the core waveguide in a first predetermined range associated with transmitting frequencies and in a second predetermined range associated with receiving frequencies, wherein the diameter of the core waveguide is reduced from the first transmitter unit to the first receiver unit to suppress TM01 mode in the first predetermined range from reaching the first receiver unit.

11. The feed network of claim 1, wherein a first group of one or more transformers are coupled between the first input port and the first end of the first waveguide reject filter and a second group of one or more transformers are coupled between the second input port and the first end of the second waveguide reject filter, and wherein the first and second groups of one or more transformers are quarter wave transformers that are configured to provide a change of size for a rectangular waveguide.

12. The feed network of claim 1, wherein the first branch is coupled to the core waveguide via a first evanescent waveguide coupled between the second end of the first waveguide reject filer and the core waveguide, wherein the second branch is coupled to core waveguide via a second evanescent waveguide coupled between the second end of the second waveguide reject filer and the core waveguide, and wherein the first and second evanescent waveguides have predetermined angles when coupled to the core waveguide.

13. The feed network of claim 1, where in the feed network is made of aluminum.

14. A receiver unit comprising:

a first branch having a first output port and a second branch having a second output port;

an integrated branch line coupler coupling the first branch and the second branch, the integrated branch line coupler comprising:

a first waveguide reject filter in the first branch comprising a first end and a second end and an outer face and an inner face, wherein the first end of the first waveguide reject filter is configured to be coupled to a circular waveguide and the second end of the first waveguide reject filter is configured to be coupled to the first output port;

a second waveguide reject filter in the second branch comprising a first end and a second end and an outer face and an inner face, wherein the first end of the second waveguide reject filter is configured to be coupled to the circular waveguide and the second end of the second waveguide reject filter is configured to be coupled to the second output port; and one or more couplers coupled between the inner face of the first waveguide reject filter and the inner face of the second waveguide reject filter;

wherein the integrated branch line coupler is configured to receive a circularly polarized signal via the first ends of the first and second waveguide reject filters from the circular waveguide and to generate a linearly polarized signal at one of the first output port or the second output port.

15. The receiver unit of claim 14, wherein the one or more couplers are configured to generate a 90 degree phase shift when transferring a linearly polarized signal between the first and second branches.

16. The receiver unit of claim 14, wherein the receiver unit is configured to receive a right hand circularly polarized signal at a first frequency from the circular waveguide and to generate an output signal at the first frequency at the first output port of the first branch.

17. The receiver unit of claim 14, wherein the receiver unit is configured to receive a left hand circularly polarized signal at a first frequency from the circular waveguide and to generate an output signal at the first frequency at the second output port of the second branch.

18. The receiver unit of claim 14, wherein the first and second waveguide reject filters are high pass filters.

19. The receiver unit of claim 14, wherein a first group of one or more transformers are coupled between the first output port and the second end of the first waveguide reject filter and a second group of one or more transformers are coupled between the second output port and the second end of the second waveguide reject filter, and wherein the first and second groups of one or more transformers are quarter wave transformers that are configured to provide a change of size for a rectangular waveguide.

20. A method of operating a transmitter unit, wherein the transmitter unit has a first branch and a second branch, the method comprising:

receiving a first linearly polarized signal from an input port of the first branch;

transmitting a first portion of the first linearly polarized signal via a first waveguide reject filter of the first branch to a circular waveguide;

generating a second linearly polarized signal by providing a quarter wavelength phase shift to a remaining second portion of the first linearly polarized signal, via a transmission of the remaining second portion of the first linearly polarized signal to the second branch through a branch line coupler coupled between the first waveguide reject filter and a second waveguide reject filter of the second branch;

transmitting the second linearly polarized signal via the second waveguide reject filter to the circular waveguide; and combining, in the circular waveguide, the first portion of the first linearly polarized signal and the second linearly polarized signal, to generate one of a right hand or a left hand circularly polarized signal in the circular waveguide.

* * * * *